US005085165A

United States Patent [19]

Reed

[11] Patent Number: 5,085,165

[45] Date of Patent: Feb. 4, 1992

[54] GANGPLANK FOR A PONTOON BOAT

[76] Inventor: William P. Reed, 11085 Chipmunk Rd., Apple Valley, Calif. 92308

[21] Appl. No.: 505,419

[22] Filed: Apr. 6, 1990

[51] Int. Cl.[5] ..... B63B 17/00

[52] U.S. Cl. ..... 114/362; 114/61; 14/71.001

[58] Field of Search ..... 114/61, 362; 14/71.1, 14/69.5, 72.5; 414/537, 140.1, 139.5, 522; 144/258-260; 296/28

[56] References Cited

U.S. PATENT DOCUMENTS

| | | | |
|---|---|---|---|
| 427,378 | 5/1890 | Thomson | 114/362 |
| 3,084,816 | 4/1963 | Bozio | 414/522 |
| 3,159,295 | 12/1964 | Love | 414/538 |
| 3,933,258 | 1/1976 | Forsyth et al. | 414/357 |
| 4,161,795 | 7/1979 | Quest | 114/362 |
| 4,242,032 | 12/1980 | Whiteman et al. | 414/537 |
| 4,624,619 | 11/1986 | Uher | 414/537 |
| 4,722,109 | 2/1988 | Mountz | 14/71.1 |
| 4,971,315 | 11/1990 | Rector | 114/61 X |
| 4,993,341 | 2/1991 | Merkel | 114/61 |

FOREIGN PATENT DOCUMENTS

| | | | |
|---|---|---|---|
| 57-99492 | 6/1982 | Japan | 114/362 |

OTHER PUBLICATIONS

Beachcomber Boats Brochure, Beachcomber West, Inc.

*Primary Examiner*—Ed Swinehart

*Attorney, Agent, or Firm*—Fleit, Jacobson, Cohn, Price, Holman & Stern

[57] ABSTRACT

A gangplank is provided stored underneath the platform deck of a pontoon boat, between the pontoons. The gangplank is retractable to a position beneath the platform deck of the boat and extendable from the position below the platform deck by a manually or electrically operated winch. In extending the gangplank, the gangplank is initially moved from the boat in a horizontal position until reaching a predetermined point at which the gangplank is lowered so as to lie on top of a surface to be accessed from the boat. Similarly, upon retracting of the gangplank, the gangplank is withdrawn towards the boat in an inclined position until reaching a predetermined point at which the gangplank is raised to a horizontal position to be withdrawn onto tracks located below the platform deck of the boat.

8 Claims, 4 Drawing Sheets

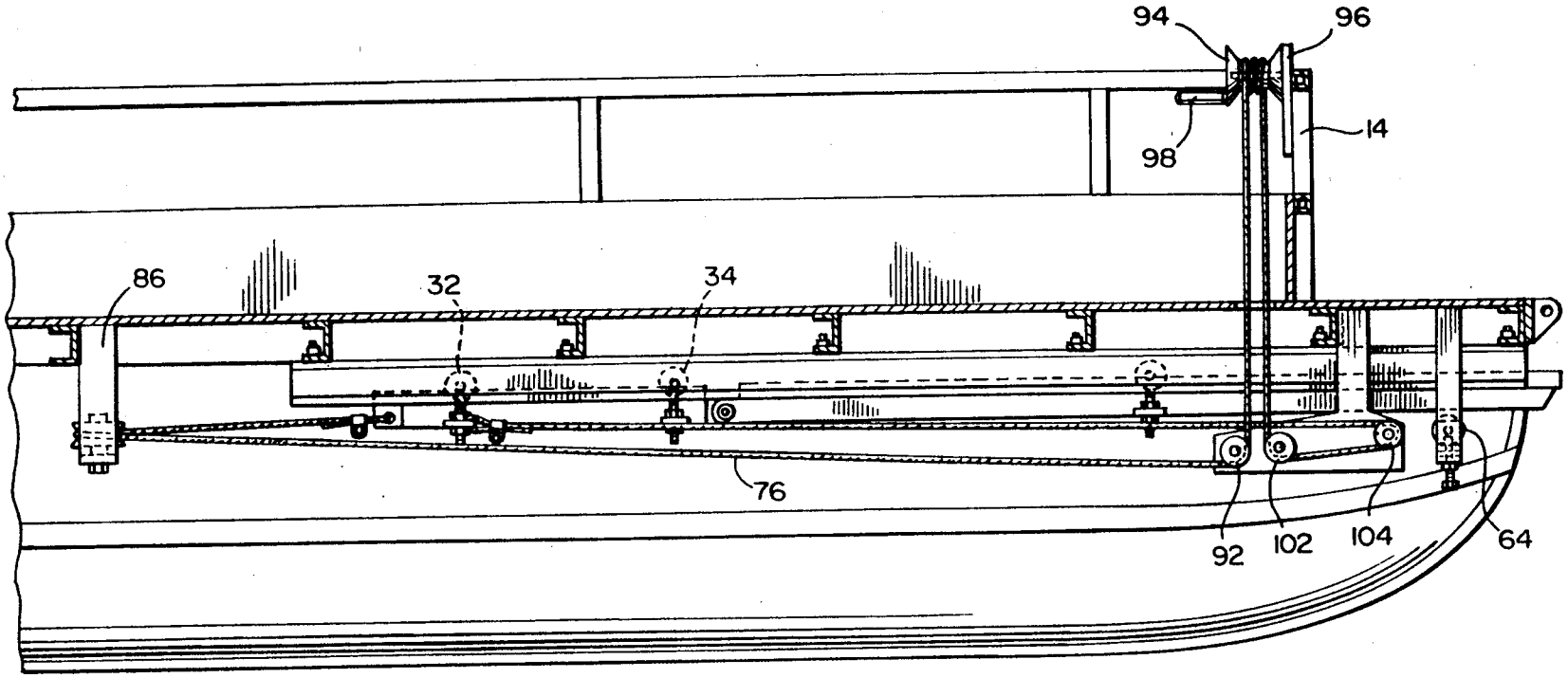
FIG. 7
FIG. 8
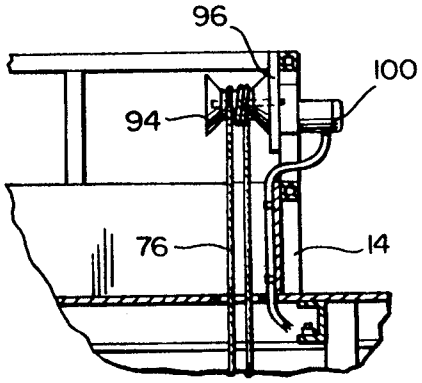

GANGPLANK FOR A PONTOON BOAT

FIELD OF THE INVENTION

This invention relates to an automatically extended and retracted gangplank stored below a platform of a pontoon boat.

BACKGROUND OF THE INVENTION

Oftentimes when traveling by pontoon boat, to gain access to the boat or upon leaving the boat, it is either necessary to jump on or off of the boat, possibly onto a muddy surface or at a distance with respect to the boat. If a gangplank is used to extend between the shore point and the boat, it is oftentimes unsecured to the boat and produces the danger of falling from the boat. Also, after use, the gangplank is stored on the deck portion of the boat, thus detracting from the available space on the deck as well as having an unsightly appearance.

SUMMARY OF THE INVENTION

By the present invention, the problem encountered with gaining access to or access from a pontoon boat is overcome. In addition, the use and storage of a gangplank is provided without detracting from available use space on the deck and without the gangplank being seen when stored.

By the present invention, a gangplank is stored underneath the platform deck of a pontoon boat, between the pontoons. The gangplank is retractable to a position beneath the platform deck of the boat and extendable from the position below the platform deck by a manually or electrically operated winch.

In extending the gangplank, the gangplank is initially moved from the boat in a horizontal position until reaching a predetermined point at which the gangplank is lowered so as to lie on top of a surface to be accessed from the boat. Similarly, upon retracting of the gangplank, the gangplank is withdrawn towards the boat in an inclined position until reaching a predetermined point at which the gangplank is raised to a horizontal position to be withdrawn onto tracks located below the platform deck of the boat.

It is an object of the present invention to provide a gangplank retractable into and extendable from a position located beneath a deck of a boat.

It is another object of the present invention to provide a gangplank retractable into and extendable from a position located beneath a deck of a boat with the movement of the gangplank caused by operation of a winch.

It is a further object of the present invention to provide a gangplank retractable into and extendable from a position located beneath a deck of a boat with the movement of the gangplank caused by operation of a winch, with the winch driving a cable connected to the gangplank so as to move the gangplank towards or away from the boat.

It is still another object of the present invention to provide a gangplank retractable into and extendable from a position located beneath a deck of a boat with the movement of the gangplank caused by operation of a winch, with the winch driving a cable connected to the gangplank so as to move the gangplank towards or away from the boat with the storage of the gangplank being located between pontoons of a pontoon boat.

These and other objects of the invention, as well as many of the intended advantages thereof, will become more readily apparent when reference is made to the following description taken in conjunction with the accompanying drawings.

BRIEF DESCRIPTION OF THE DRAWINGS

FIG. 7 is a side elevation, partly in section, through the pontoon boat, illustrating a manually-operated driving winch.

FIG. 8 is a side elevation, partly in section, through the pontoon boat illustrating an electrically-driven winch.

DETAILED DESCRIPTION OF THE PREFERRED EMBODIMENTS

Figure 1:
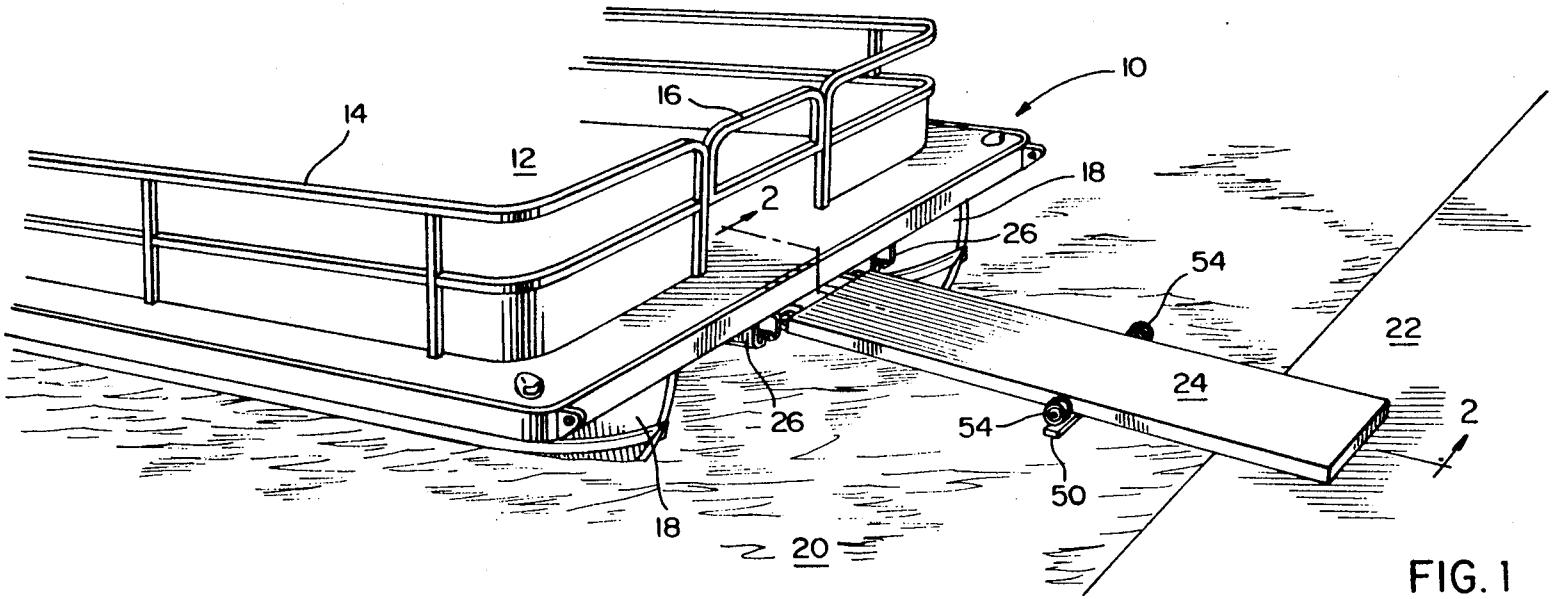
FIG. 1 is a perspective view of a gangplank extended from a pontoon boat.

In describing a preferred embodiment of the preferred invention illustrated in the drawings, specific terminology will be resorted to for the sake of clarity. However, the invention is not intended to limited to the specific terms so selected and it is to be understood that each specific term includes all technical equivalents which operate in a similar manner to accomplish a similar purpose.

With reference to the drawings, in general, and to FIGS. 1 through 6, in particular, a pontoon boat embodying the teachings of the subject invention is generally designated as 10. The boat 10 includes a platform deck 12 with a protective railing 14 and a gate 16. Two pontoons 18 support the boat in the water 20 adjacent to a shore point or dock 22.

Figure 2:
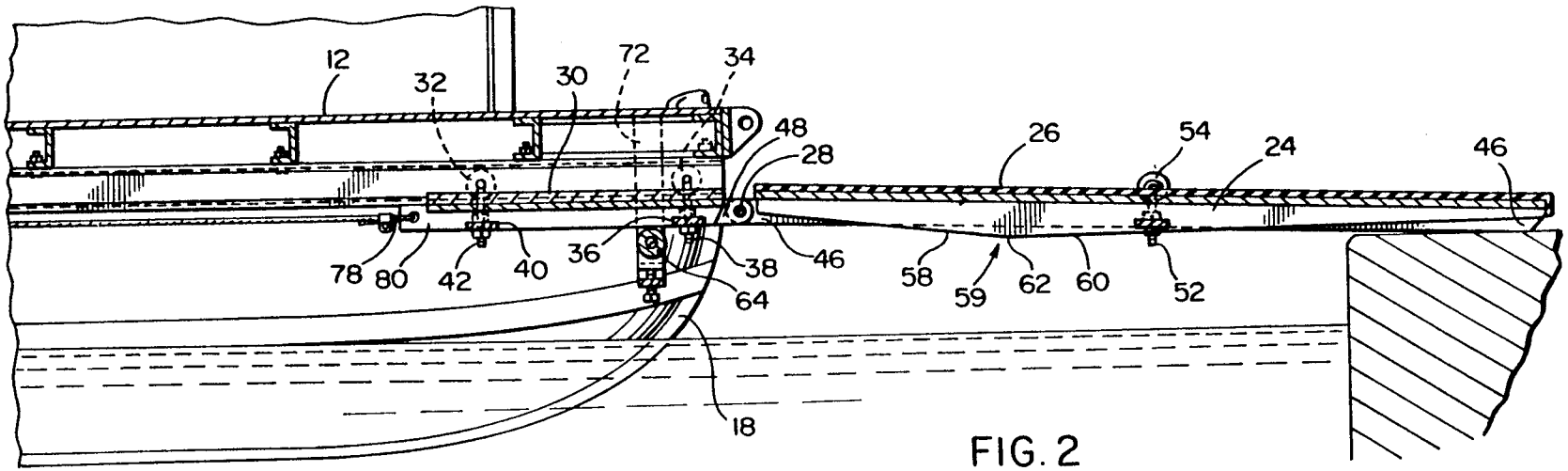
FIG. 2 is a longitudinal section taken along line 2—2 of FIG. 1.
Figure 3:
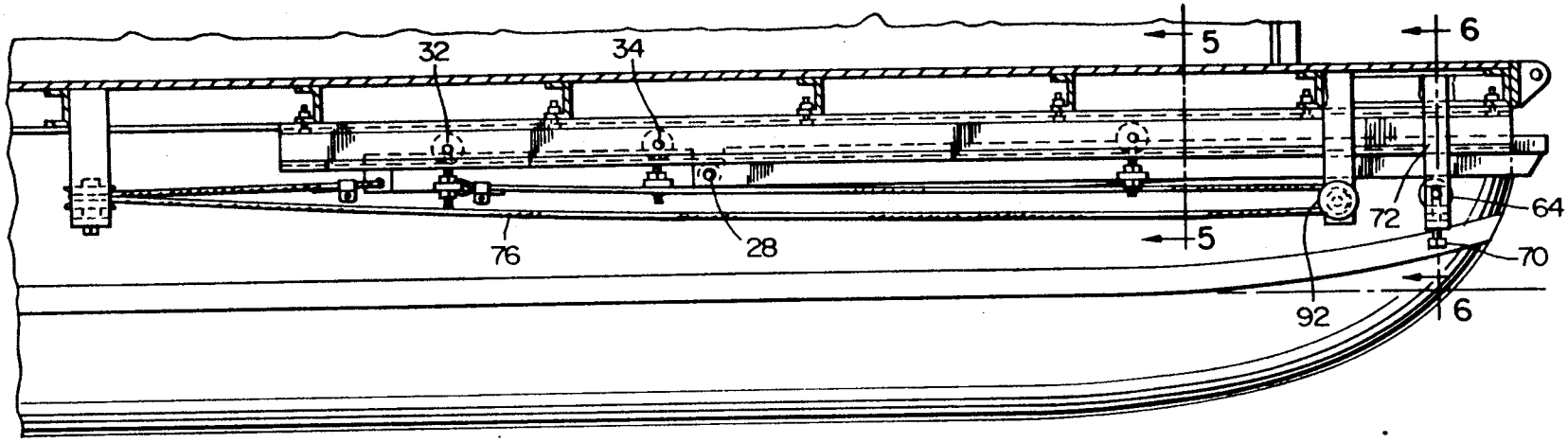
FIG. 3 is a longitudinal section through the pontoon boat with the gangplank shown in a retracted position.
Figure 4:
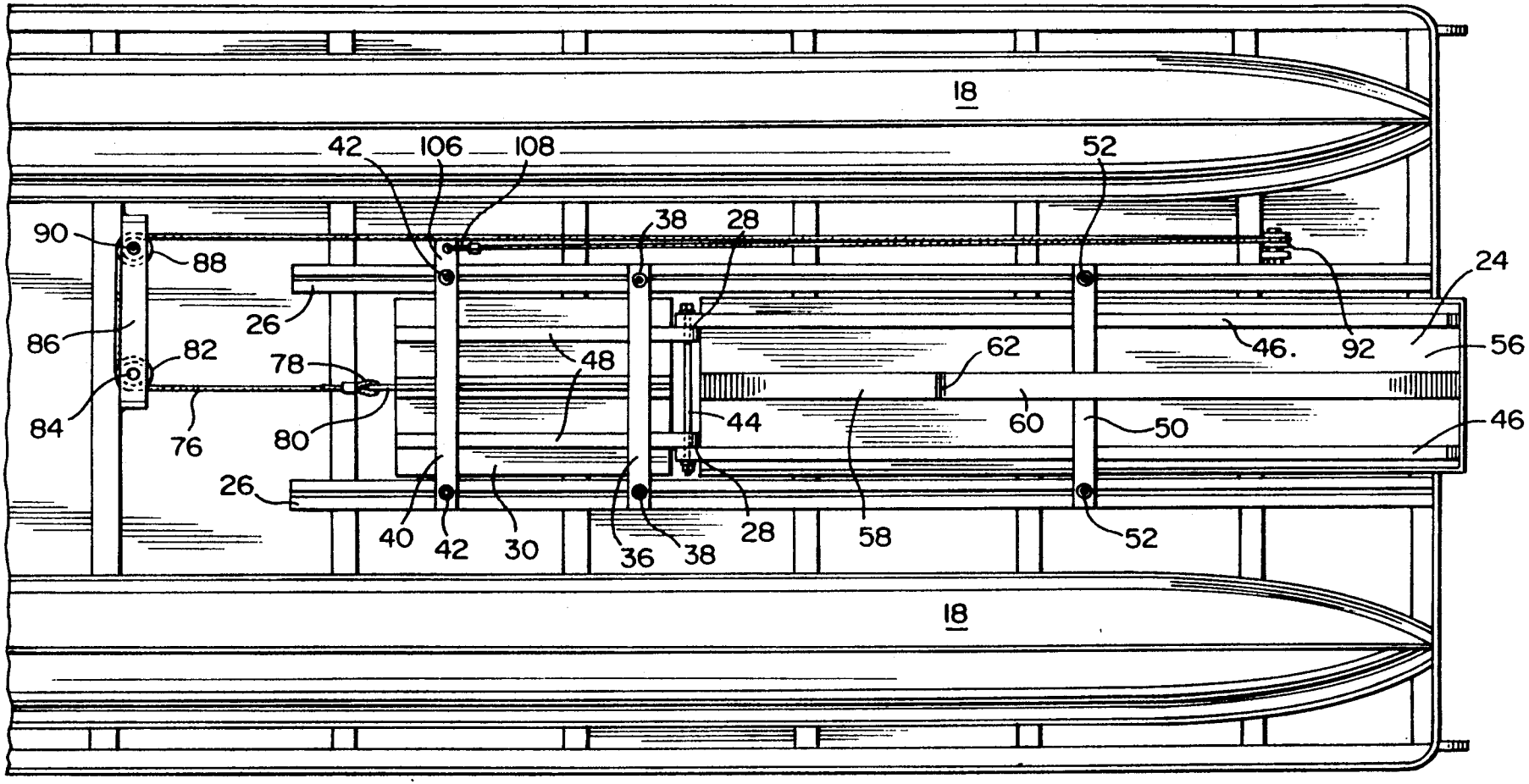
FIG. 4 is a bottom view of the pontoon boat with the gangplank in the retracted position.

To gain access to the platform deck from the shore point 22, a gangplank 24 is movably mounted between an extended position as shown in FIGS. 1 and 2 and a retracted position as shown in FIGS. 3, 4 and 7. The gangplank 24 includes an uppermost surface covered by carpet 26 for traction.

Located below the platform 12 are two guide rails 26 in a C-shaped configuration defining tracks 28 for supporting double-wheeled rollers. The gangplank is pivotably connected at two points about pivots 28 to a guide section 30 slidably mounted on the rail 26. The guide section 30 includes a forward set of rollers 32 and a rear set of rollers 34 mounted within the profile of the guide rails 26 for a reciprocative movement along the rails 26 between opposite ends of the rails 26.

In FIG. 4, the guide section is shown including a crosspiece 36 for supporting the rear rollers 34 by bolts 38 and a crosspiece 40 for supporting the forward rollers 32 by bolts 42. In FIG. 4, the two pivots interconnections 28 spaced along pivot rod 44 are shown. Also in FIG. 4, the undersurface of the gangplank 24 is shown with two longitudinal ribs 46 located adjacent to outer edges of the gangplank and extending longitudinally along the length of the gangplank to be pivotally secured to two ribs 48 of the guide section to form the pivots 28 between the gangplank and the guide section 30. At an approximate midpoint of the gangplank 34 is crosspiece 50 through which bolts 52 are secured to hold rollers 54 on opposite sides of the gangplank as shown in FIG. 1.

Figure 6:
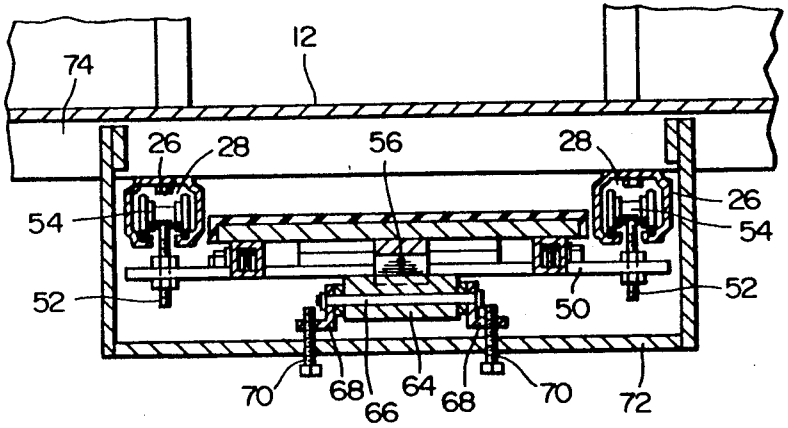
FIG. 6 is a cross-section as viewed along line 6—6 of FIG. 3.
Figure 5:
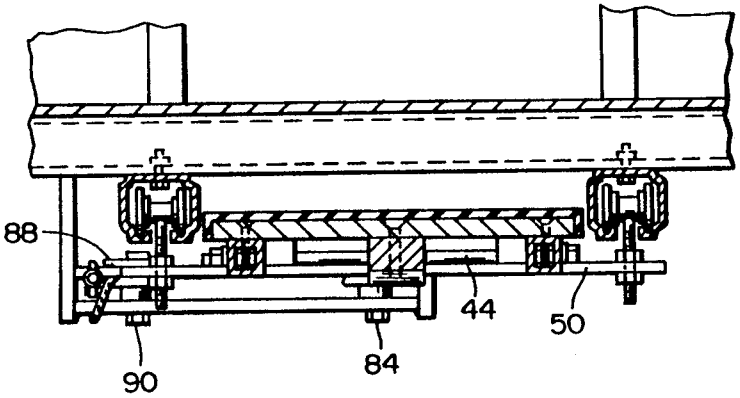
FIG. 5 is a cross-section as viewed along line 5—5 of FIG. 3.

A third centrally located rib 56 extends between the opposite ends of the gangplank in the longitudinal direction. The rib 56 includes two inclined portions 58 and 60 which meet at apex 62 to form a cam surface 59. The central rib 56 is aligned so as to engage a stationary roller 64 mounted on shaft 66 between two L-shaped angle brackets 68 for vertical adjustment of roller 64 by rotation of threaded bolts 70, as shown in FIG. 6. The bolts 70 extend through a C-shaped housing 72 anchored to a crossbeam 74 extending across the bottom of platform 12.

The height of roller 64 is adjustable by rotation of the bolts 70 for contact with the cam surface of rib 56 so that as the gangplank is withdrawn under the boat, surface 58 will contact the roller 64 to elevate the gangplank from an inclined position to a horizontal position at which the rollers 54 will be introduced into the opening of the guide rails 26 for carrying of the rollers 54 and therefore the gangplank 24 within the tracks 28 of the guide rails 26 after passage of the apex 62 over the guide roller 64. Similarly, when withdrawing the gangplank from under the boat, the gangplank will be maintained in a horizontal position as supported by the rollers 54 within the tracks 28 until the rollers 54 emerge from the tracks and the gangplank is supported by the inclined surface 58 of the rib 56 and the gangplank is lowered about pivots 28 by the rolling of the surface 58 on the roller 64.

To move the gangplank between the extended and retracted position, a steel cable 76 is secured at one end 78 through an elongated member 80 which is secured to crosspiece 40 of guide section 30. The cable then extends around pulley 82 rotatably mounted on a pin 84 secured in a bracket 86, which is attached to the underside of the platform 12. The cable next extends around a second pulley 88 also secured within bracket 86 by pin 90. The direction of the cable then extends longitudinally along the longitudinal axis of the boat around pulley 92. The cable then extends vertically and is wrapped around winch 94 which is mounted on the railing 14 by mounting plate 96.

In FIG. 7, the winch 94 is rotated manually by grabbing handle 98 and turning of the winch according to the desire to extend or retract the gangplank 24. In FIG. 8, the winch 94 is driven by a reversing electric motor 100 by actuation of a switch (not shown) to drive the winch 94 in opposite directions according to the desire to extend or retract gangplank 24.

The cable 76 then extends vertically downward around pulley 102 which is laterally offset from pulley 92 by the width of the portion of the winch about which the cable is wrapped and omitted from the views other than FIG. 7 for clarity along with the omission from the other views of pulley 104 about which the cable extends to reverse the direction of the cable so that the cable extends rearwardly along the longitudinal axis of the boat. The cable is secured to an extension 106 of crosspiece 40 at end 108 of the cable. This completes the closed loop of the cable 76.

To move the gangplank from the retracted position as shown in FIG. 7 to the extended position as shown in FIG. 1, the winch 94 is rotated so that a force is directed on the crosspiece 40 to pull the gangplank out from underneath the boat. The gangplank extends horizontally from the guide rails 26 until the rollers 54 clear the guide rails. At this moment, the inclined surface 58 of the central rib 56 contacts roller 64. Upon continued movement of the gangplank, the inclined surface 58 rolling across the roller 64 causes the gangplank to be lowered about pivot points 28 according to the angle of the inclined surface 58, or until a leading edge of the gangplank contacts a shore point 22.

Similarly, for retracting the gangplank underneath the boat, the winch 94 is rotated in an opposite direction to that for extending of the gangplank so that the gangplank is raised by the riding of inclined surface 58 on roller 64 to raise the gangplank from an inclined position to a horizontal position at a point at which the rollers 54 enter the guide rails 26. Upon continued retraction of the gangplank, the rollers 54 ride within the tracks 28 of the guide rails until complete retraction of the gangplank underneath the platform deck as shown in FIGS. 3, 4 and 7.

Having described the invention, many modifications thereto will become apparent to those skilled in the art to which it pertains without deviation from the spirit of the invention as defined by the scope of the appended claims.

I claim:

1. A system for gaining access to and exiting from a boat, said system comprising:

a boat having a deck, guide rails located below the deck, a guide section mounted on said guide rails, a gangplank pivotably mounted to the guide section, said gangplank including a longitudinally extending rib, a cable having two ends connected to the guide section for extending and retracting the gangplank according to a direction of movement of the cable, and a guide roller mounted below the deck for engaging the rib to raise and lower the gangplank during extension and retraction of the gangplank.

2. A system for gaining access to and exiting from a boat as claimed in claim 1, wherein said cable is trained about a winch.

3. A system for gaining access to and exiting from a boat as claimed in claim 2, wherein the winch is manually operated.

4. A system for gaining access to and exiting from a boat as claimed in claim 2, wherein the winch is electrically operated.

5. A system for gaining access to and exiting from a boat as claimed in claim 1, wherein the guide roller is height adjustable.

6. A system for gaining access to and exiting from a boat as claimed in claim 1, wherein the rib includes two inclined portions defined by a bottom edge of the rib.

7. A system for gaining access to and exiting from a boat as claimed in claim 1, wherein the gangplank includes two additional ribs pivotably connected to two ribs of the guide section for the pivotal mounting of the gangplank to the guide section.

8. A system for gaining access to and exiting from a boat, said system comprising:

a boat having a deck, guide rails located below the deck, a guide section mounted on said guide rails, a gangplank pivotably mounted to the guide section, said gangplank including a longitudinally extending rib, a cable having two ends connected to the guide section for extending and retracting the gangplank according to a direction of movement of the cable, a guide roller mounted below the deck for engaging the rib to raise and lower the gangplank during extension and retraction of the gangplank, and said boat being a pontoon boat having two pontoons and the guide rails being located between the two pontoons.

* * * * *